US008017889B2

(12) United States Patent
Adamski

(10) Patent No.: US 8,017,889 B2
(45) Date of Patent: Sep. 13, 2011

(54) RADIANT CONVECTION BAFFLE FOR OVENS

(76) Inventor: Joseph R. Adamski, Pasadena, CA (US)

( * ) Notice: Subject to any disclaimer, the term of this patent is extended or adjusted under 35 U.S.C. 154(b) by 822 days.

(21) Appl. No.: 11/913,751

(22) PCT Filed: May 8, 2006

(86) PCT No.: PCT/US2006/017916

§ 371 (c)(1),
(2), (4) Date: Nov. 6, 2007

(87) PCT Pub. No.: WO2006/122118

PCT Pub. Date: Nov. 16, 2006

(65) Prior Publication Data

US 2008/0190911 A1 Aug. 14, 2008

Related U.S. Application Data

(60) Provisional application No. 60/679,212, filed on May 9, 2005.

(51) Int. Cl.
*A21B 1/00* (2006.01)
*F24C 15/32* (2006.01)

(52) U.S. Cl. ..... 219/400; 219/399; 219/391; 219/405; 126/21 A; 126/21 R; 126/19 R; 126/273 R; 99/474; 99/475

(58) Field of Classification Search ..... 219/398–400, 219/391, 405; 126/21 A, 21 R, 19 R, 273 R; 99/474–5

See application file for complete search history.

(56) References Cited

U.S. PATENT DOCUMENTS

| | | | | |
|---|---|---|---|---|
| 3,529,582 A * | 9/1970 | Hurko et al. | ..... | 126/21 R |
| 4,113,439 A | 9/1978 | Ookubo et al. | | |
| 6,318,245 B1 | 11/2001 | Durth et al. | | |

FOREIGN PATENT DOCUMENTS

| | | |
|---|---|---|
| DE | 28 03 910 | 8/1978 |
| DE | 2803910 * | 8/1978 |
| DE | 36 36 622 A1 | 5/1988 |
| DE | 41 39 904 A1 | 6/1993 |
| DE | 203 09 600 U1 | 7/2004 |

* cited by examiner

*Primary Examiner* — Shawntina Fuqua
(74) *Attorney, Agent, or Firm* — Schiff Hardin LLP

(57) ABSTRACT

A baffle that can be used in an oven includes, according to one embodiment, a fan, a catalyst, a heater between the fan and the catalyst, and/or a support structure. The support structure supports the fan, the catalyst, and/or the heater. The fan is arranged to circulate air over the heater and/or the catalyst. The support structure includes, for example, a wing, which, if used, is arranged to deflect circulating air.

28 Claims, 7 Drawing Sheets

RADIANT CONVECTION BAFFLE FOR OVENS

RELATED APPLICATIONS

The present application claims the benefit of U.S. Provisional Application Ser. No. 60/679,212 filed on May 9, 2005, the disclosure of which is incorporated herein by reference.

TECHNICAL FIELD OF THE INVENTION

The present invention relates to commercial and residential appliances such as ovens.

BACKGROUND OF THE INVENTION

Convection cooking has slowly but surely found its place in mainstream kitchen cooking products. Convection cooking appliances use a combination of heaters and fans to circulate oven air, which is maintained at a user selected cooking temperature by a microcontroller or gas expansion thermostat, over the heater and the food being heated.

In standard non-convection bake and broil cooking, a thermal boundary layer is formed near the food product being heated. This boundary layer can reduce heat transfer to the food by a nominal 25%. The circulating fan in current art convection ovens serves to break up this boundary layer.

Furthermore, some of these convection systems are designed with a resistive heating element surrounding the fan impeller, creating what the appliance industry calls "true convection" cooking. This fan associated heating element is often used to increase the temperature of the circulating air, thereby supplying cabinet losses present in the oven cavity as well as energy required to heat the food. Current convection ovens provide little if any radiant heating of food product placed in the oven cavity.

Smoke and odor elimination in connection with current food heating appliances are typically handled by bleeding a small amount of range or oven cavity air into a single pass, low temperature catalytic element located between the range cavity and the appliance's exhaust plenum to oxidize airborne cooking products on their way to the kitchen air. These single pass systems cannot effectively handle the large quantities of smoke and odor created in high performance and high power bake and broil ovens, nor are they well suited for smoke and odor handling present in higher temperature (>500° F.) self-clean operations.

U.S. Pat. No. 6,318,245 B1 by Durth et al. and U.S. Pat. No. 4,113,439 by Ookubo et al. present cooking devices having catalysts. The present invention is a novel improvement over these and other devices.

SUMMARY OF THE INVENTION

According to one aspect of the present invention, an oven comprises a top, a bottom, first and second vertical sides, and a baffle. The top, the bottom, and the first and second vertical sides define a heating cavity that receives food to be heated. The baffle is positioned to circulate air in from the heating cavity, through the baffle, and back out to the heating cavity. The baffle includes a fan, a catalyst, a heating element, and a transparent shield. The fan circulates the air, the heating element produces radiation, the catalyst removes contaminants from the circulating air, and the transparent shield permits the radiation to enter the heating cavity.

According to another aspect of the present invention, an oven comprises a top, a bottom, first and second vertical sides, and a baffle. The top, the bottom, and the first and second vertical sides define a heating cavity that receives food to be heated. The baffle is positioned to circulate air in from the heating cavity, through the baffle, and back out to the heating cavity. The baffle includes a fan, a catalyst, and a support structure. The fan circulates the air, and the catalyst removes contaminants from the circulating air. The support structure has a wall and a wing, and the wing extends at a non-right angle from the wall and directs air circulated by the fan back into the heating cavity.

According to still another aspect of the present invention, an oven baffle comprises a fan, first and second catalysts, a heater located so as to heat the first and second catalysts, and a support structure. The support structure supports the fan, the first and second catalysts, and the heater. The fan is arranged to circulate air over the heater and the first and second catalysts. The support structure includes first and second wings, the first wing is arranged to deflect air circulated by the fan in one direction, and the second wing is arranged to deflect air circulated by the fan in an opposite direction.

BRIEF DESCRIPTION OF THE DRAWINGS

These and other features and advantages will become more apparent from a detailed consideration of the invention when taken in conjunction with the drawings in which.

DETAILED DESCRIPTION

Figure 1:
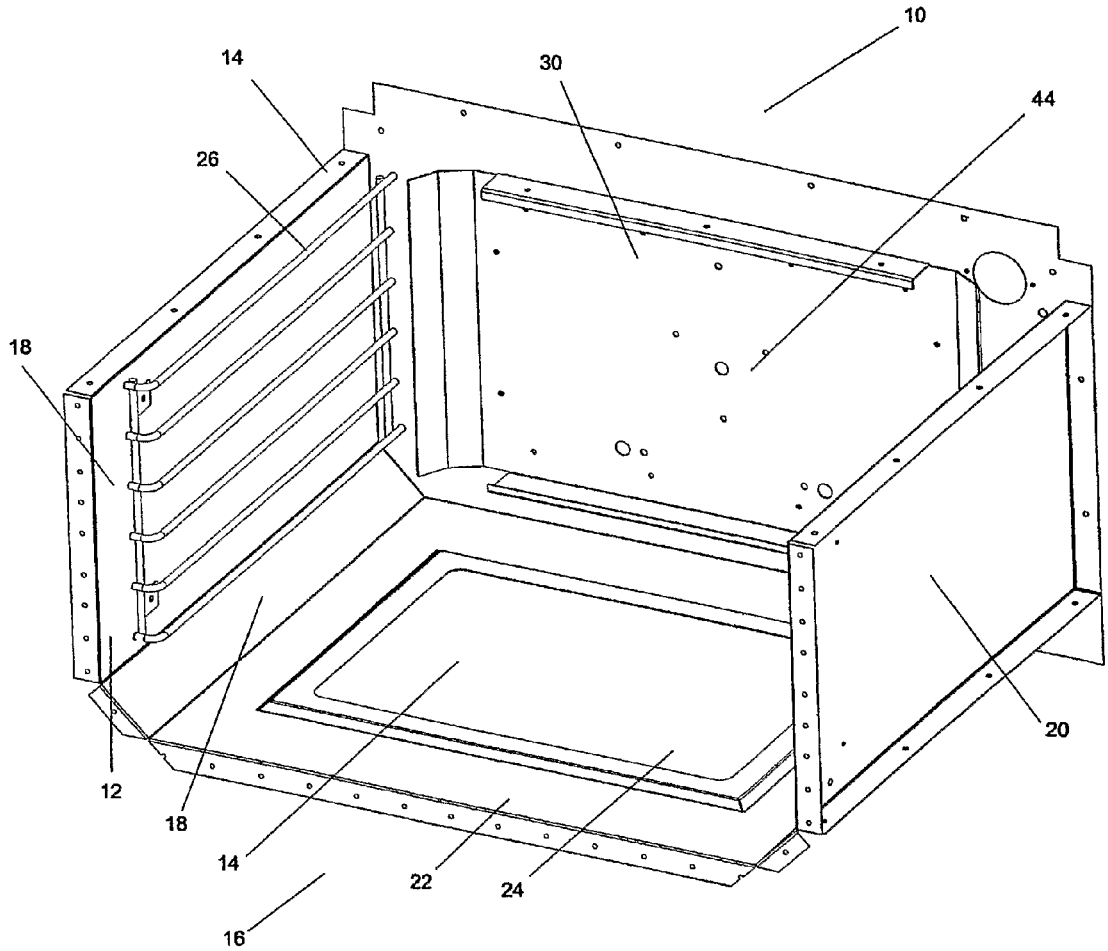
FIG. 1 illustrates an oven according to one embodiment of the present invention.

FIG. 1 shows an oven 10, in part. While the example embodiment of the present invention as shown in FIG. 1 is a single oven, the present invention may be implemented as a double oven, a stove, etc. The oven 10 has an oven cell 12 defining a heating cavity 14 that is accessible through a front opening 16. The front opening 16 typically cooperates with a door (not shown) to permit access to the heating cavity 14 and to close off the heating cavity 14 during heating.

The oven cell 12 has vertical cell side walls 18 and 20, a cell top (not shown), and a cell bottom 22. The cell top and the door have been omitted so as to better display the heating cavity 14 of the oven 10. The cell bottom 22 has an opening 24 to receive a heating element that is utilized to the heat the heating cavity 14. The cell top may also have a similar opening to receive a heating element that is utilized to the heat the heating cavity 14.

A first rack support 26 is suitably attached to the vertical cell side wall 20, and a second rack support (not shown) is suitably attached to the vertical cell side wall 18 so as to support oven racks (not shown).

The back of the oven cell 12 has a rear baffle 30 defining the rear of the heating cavity 14. In one embodiment, the rear baffle 30 may be comprised of a formed metal structure that mechanically supports a convection fan motor and fan impeller, one or more heating elements, a transparent shield, and a catalyst, and may as well provide air directing elements (e.g., wings) to deflect hot air flow from the fan impeller into the heating cavity 14. The rear baffle 30 may be designed to be installed and removed from inside the heating cavity 14, thereby simplifying repair by service personnel in the event of component failure.

Figure 2:
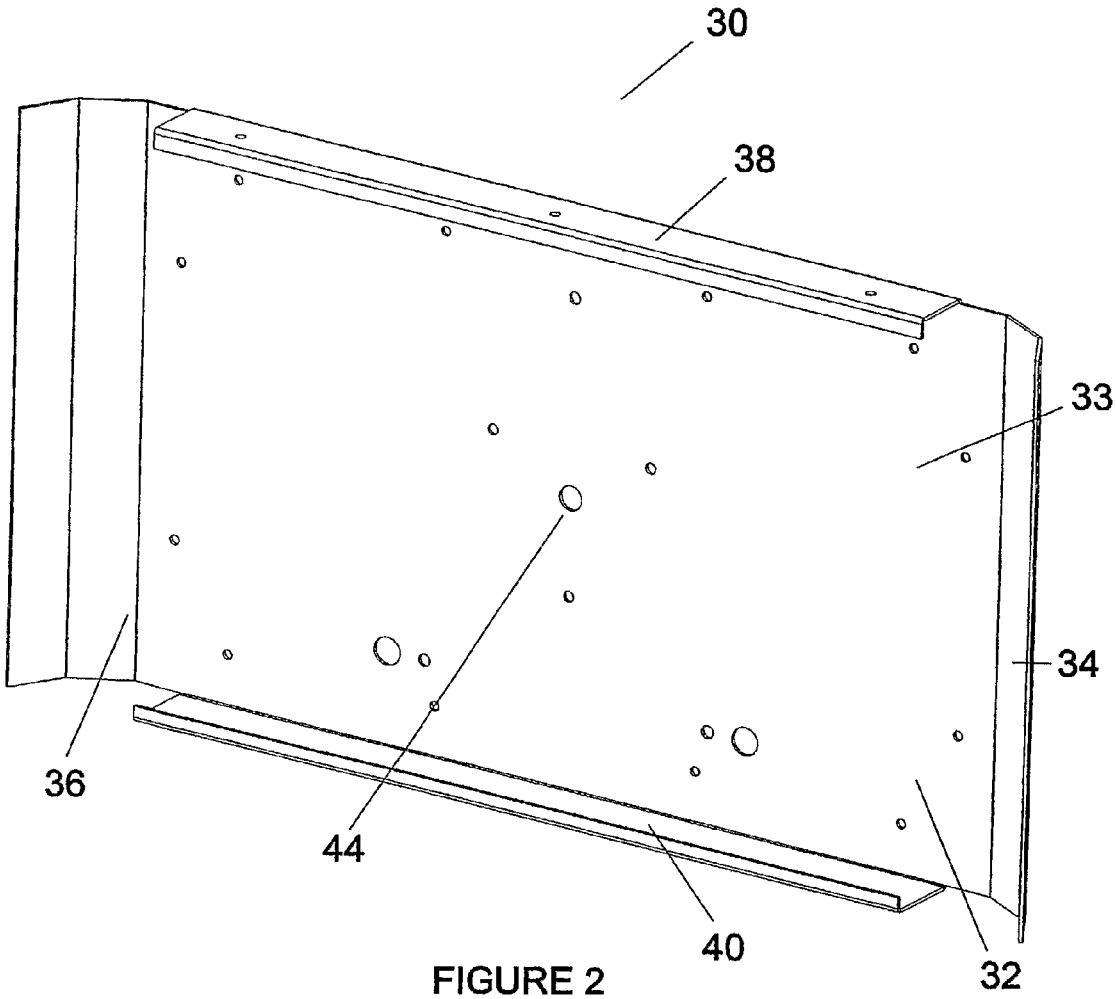
FIG. 2 illustrates a support structure of a baffle that can be used with the oven of FIG. 1.

As shown in FIG. 2, a support structure 32 of the baffle 30 is formed so as to have a back wall 33, wings 34 and 36 extending at non-right angles from the back wall 33, and flanges 38 and 40 extending at right angles from the back wall 33. The flanges 38 and 40 have fastener receiving holes so that the support structure 32 may be fastened to the oven cell 12. Accordingly, the flange 38 receives fasteners from within the heating cavity 14 to fasten the support structure to the cell top of the oven cell 12, and the flange 40 receives fasteners from within the heating cavity 14 to fasten the support structure to the cell bottom 22 of the oven cell 12.

The support structure 32, for example, may comprise one piece of steel that is formed so as to have the back wall 33, the wings 34 and 36, and the flanges 38 and 40. The support structure 32 may be porcelainized to resist rusting and for ease of cleaning. The porcelain used to porcelainize the support structure 32 may have an emissivity of 0.92, and exhibits a high absorptive and high re-radiative ability. A low emissivity reflective element may be positioned on the side of the support structure 32 that faces the heating cavity 14 so as direct energy out of the rear baffle 30 and into the heating cavity 14 and onto the food.

Figure 3:
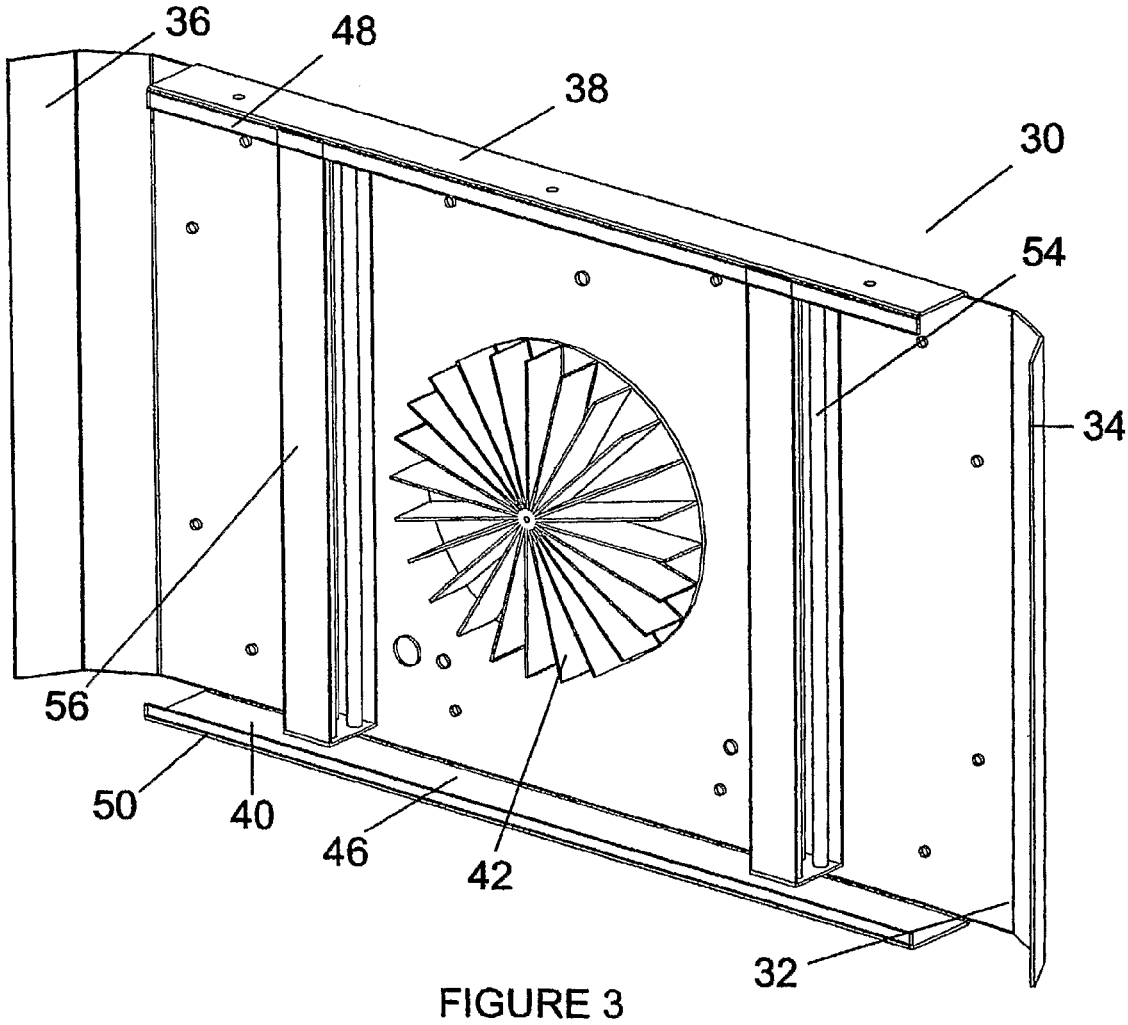
FIG. 3 illustrates the support structure of FIG. 2 with a fan and heating elements.

As shown in FIG. 3, a circulating fan 42 having a fan motor and a fan impeller is mounted to the rear baffle 30 at a fan location 44 (FIG. 2). The circulating fan 42, for example, may operate at a nominal 100 CFM flow rate (but fans operating at other flow rate could instead be used) and is mounted in the center of the support structure 32. The fan motor/impeller shaft of the circulating fan 42 may be sufficiently long to displace the motor bearings and electrical windings to the cooler environment present outside the heating cavity 14 in the back of the oven 10. The rear baffle 30, for example, may be 1.5" thick and, in any event, should be thin enough that it does not reduce the useful capacity of the heating cavity 14.

Figure 4:
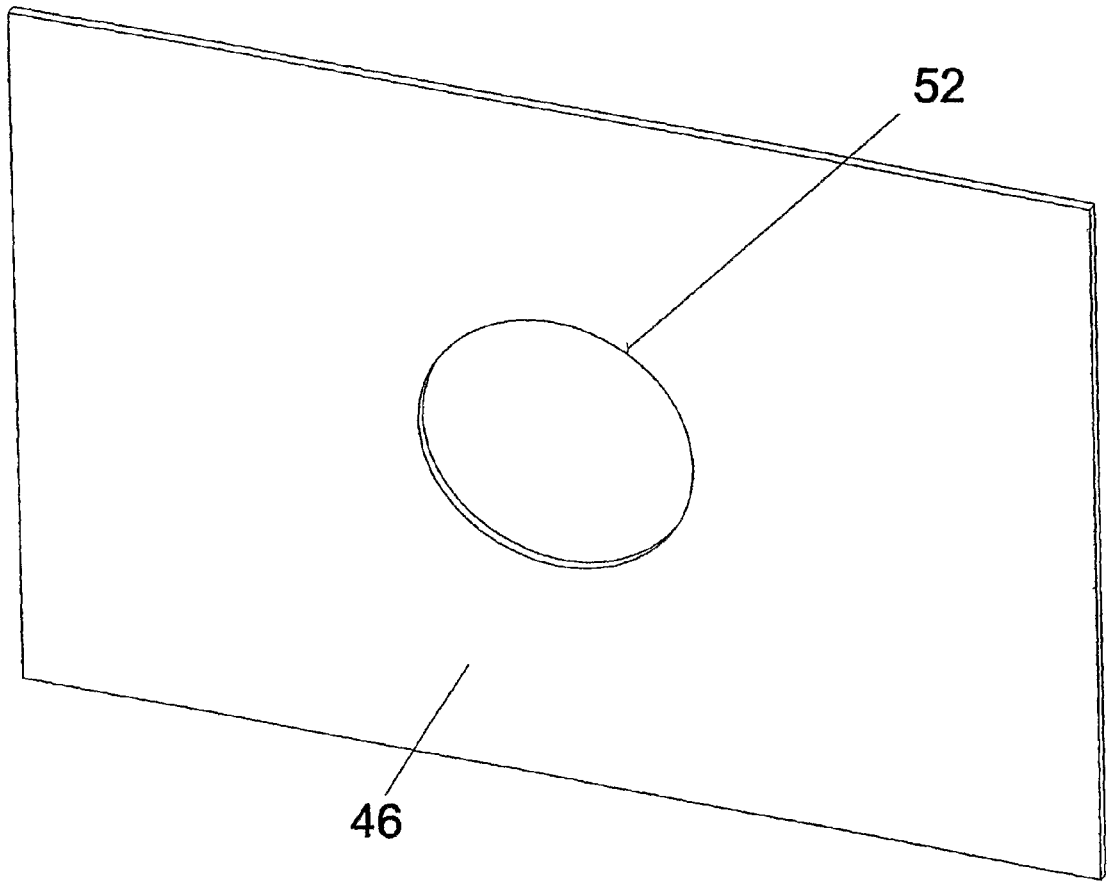
FIG. 4 illustrates a transparent shield that can be used with the support structure of FIG. 2.

A transparent shield 46 shown in FIG. 4 closes off the front of the rear baffle 30 and is secured to the baffle 30 by flaps 48 and 50 of the flanges 38 and 40. The transparent shield 46 has an air intake opening 52 such as at its center to permit air to be drawn into the rear baffle 30 from the heating cavity 14 by the circulating fan 42. The generally radial exhaust of the circulating fan 42 is constrained by the support structure 32 to flow in a left and/or right exit direction. The support structure 32, for example, may be generally rectangular.

The transparent shield 46, for example, may be a glass shield such as a glass ceramic shield, covers the support structure 32, and provides the air intake opening 52 for the circulating fan 42. A "finger guard" may be provided in connection with the air intake opening 52 so as protect the operator from injury, and a "splatter guard" may be provided to protect the circulating fan 42 from food splatters which may degrade long term performance. The transparent shield 46, for example, may be generally constructed from Schott Ceran or Robax glass, a material that exhibits very high transparency in the infrared region of the electromagnetic spectrum.

Figure 5:
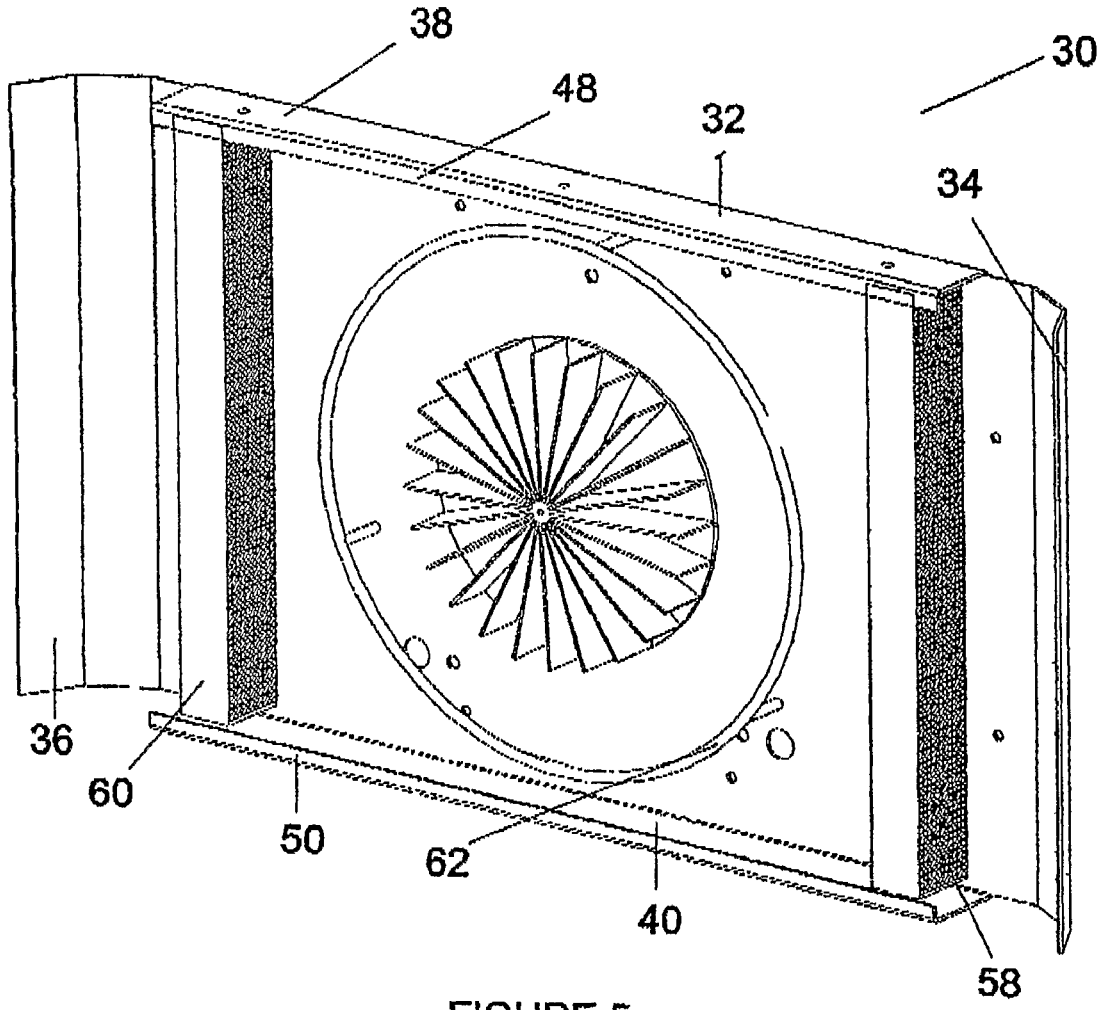
FIG. 5 illustrates the support structure of FIG. 2 with the fan and catalysts.

As shown in FIG. 3, the rear baffle 30 includes heating elements 54 and 56 on either side of the circulating fan 42 (though the present invention is not limited to heaters on the left and/or right side of the circulating fan 42). The heating elements 54 and 56 are oriented to allow airflow across the surface of the heaters, to launch infrared energy into the heating cavity 14, and to directly illuminate the surface structures of catalytic elements 58 and 60 (FIG. 5). These catalytic elements 58 and 60, for example, may be ceramic honeycomb plated with platinum or ripple strips of iron coated with platinum that when stacked form a honeycomb like structure. As indicated above, a smooth or polished reflecting surface may be provided behind the heating elements 54 and 56 to improve the redirection of their radiation into the heating cavity 14.

As shown in FIG. 5, the rear baffle 30 includes the catalytic elements 58 and 60. The catalytic elements 58 and 60 may be placed in close proximity to the heating elements 54 and 56, respectively, so that the catalytic elements 58 and 60 are situated between the heating elements 54 and 56 and the wings 34 and 36 of the support structure 32. The catalytic elements 58 and 60, for example, may be generally honeycomb shaped elements and may be coated with a precious metal to reduce, by catalytic action, the temperature at which combustion of airborne products occurs. For proper operation, the catalytic elements 58 and 60 should be heated to a temperature higher than standard cooking functions permit. The proximity of the heating elements 54 and 56 to the catalytic elements 58 and 60 allows this high temperature heating to occur. The hot air that is required to heat the food in the heating cavity 14 is created by heat transfer flowing through the catalytic elements 58 and 60 combined with the heat transfer flowing through the "red hot" heater wires mounted at the opening in the cell top and/or in the cell bottom 22.

Alternatively, instead of using the heating elements 54 and 56 between the catalytic elements 58 and 60 and the circulating fan 42, an arcuate heating element 62 shown in FIG. 5 may partially or fully surround the circulating fan 42. The heating elements 54, 56, and/or 62 may be radiant heaters. More specifically, the heating elements 54, 56, and/or 62, for example, may be fabricated from nichrome or kanthal resistive wire that is similar to the heating wire used in countertop toasters.

In the case where the heating elements 54, 56, and/or 62 are radiant heaters, the transparent shield 46 may be an IR transparent shield to allow infrared radiation created by the heating elements 54, 56, and/or 62 to directly illuminate the walls of the heating cavity 14, as well as the food products, ovenware, or tableware placed on the racks of the oven 10. This direct radiation improves pre-heat time as well as cooking times for food items placed in the heating cavity 14 and enables a fast and high quality "warming" function. The transparent shield 46 further forms one side of the air flow plenum provided by the rear baffle 30.

The back wall 33 of the support structure 32 has fastener receiving holes useful to fasten the circulating fan 42, the heating elements 54, 56, and/or 62, and the catalytic elements 58 and 60 to the support structure 32. Moreover, the support structure 32 has a further hole to receive the fan motor/impeller shaft of the circulating fan 42 so that the motor bearings and electrical windings of the circulating fan 42 are on the cooler side of the support structure and so that fan impeller of the circulating fan 42 is between the heating elements 54, 56, and/or 62.

Figure 6:
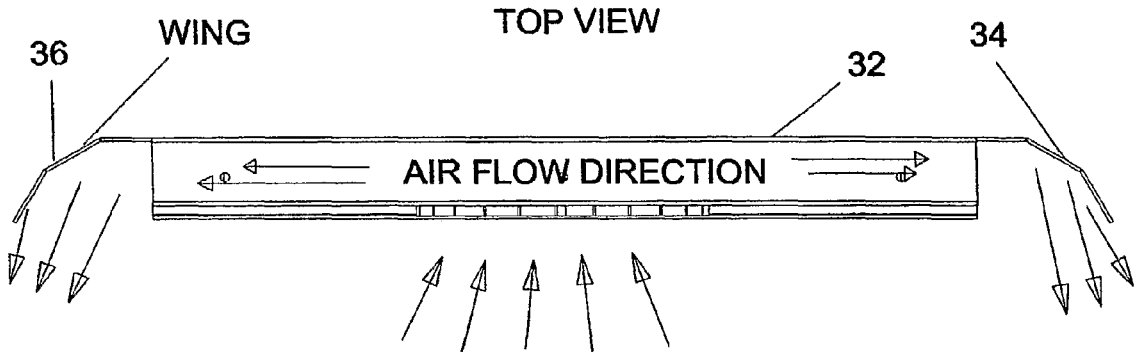
FIG. 6 is a top view of the baffle of FIGS. 2-5 showing the flow of circulating air; and, FIG. 7 is a top view of the oven of FIG. 1 also showing the flow of circulating air.
Figure 7:
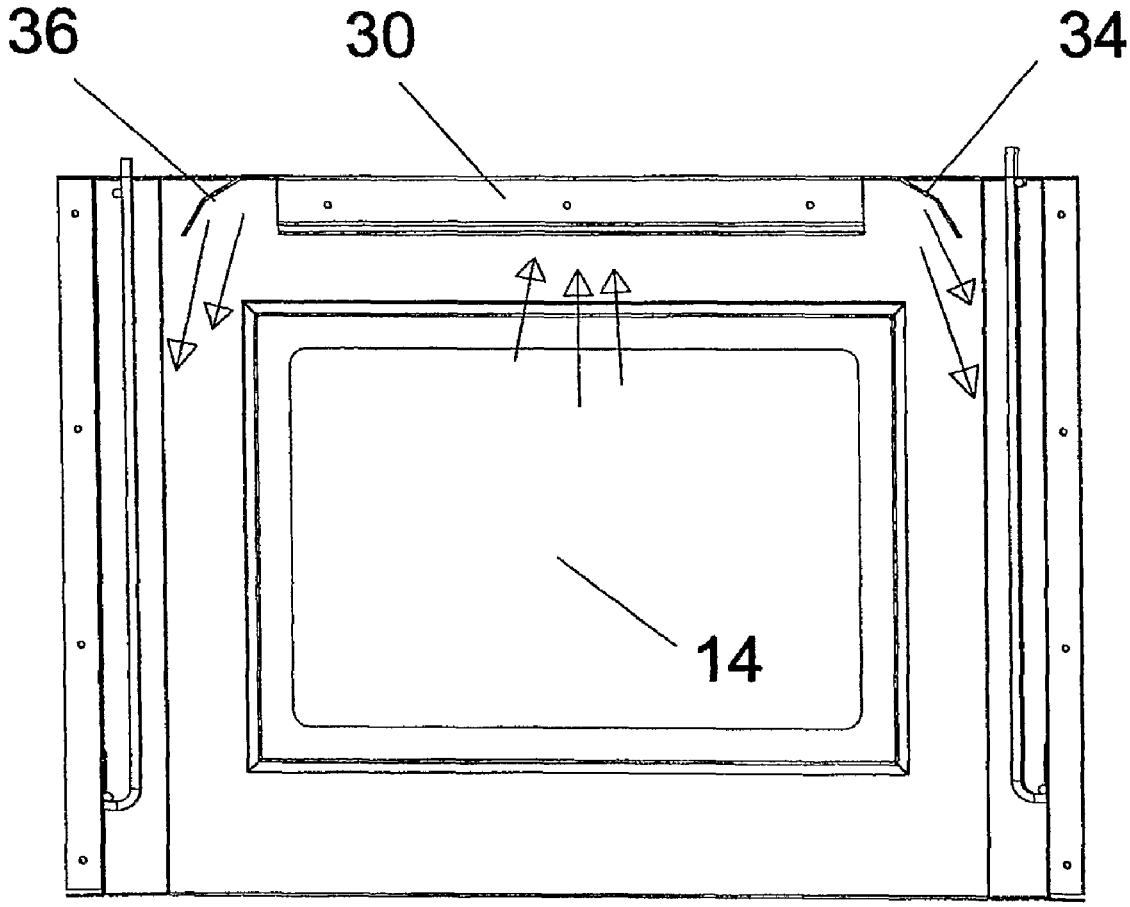

As shown in FIG. 6, the wings 34 and 36 of the support structure 32 redirect air flowing in generally left and right directions at the back of the oven 10 toward the heating cavity 14 where the food is located. FIG. 7 is a top view of the heating cavity 14 and also shows the circulation of air provided by the rear baffle 30.

The circulating fan 42, the heating elements 54, 56, and/or 62, the catalytic elements 58 and 60, the wings 34 and 36, and/or the transparent shield 46 can create, for example, a re-circulating 80 CFM air supply in a nominal six cubic feet oven—roughly providing thirteen "air changes" per minute for the catalytic elements 58 and 60 to burn the contaminants in the oven 10.

In an embodiment, the support structure 32 may be formed from low carbon, cold-rolled steel and porcelainized as described above. As also described above, the circulating fan 42 may be mounted on the support structure 32 by use of holes therein, the impeller shaft of the circulating fan 42 may pass through the support structure 32, the heating elements 54, 56, and/or 62 may be attached to the support structure 32 on either side of the circulating fan 42 by use of fasteners, the catalytic elements 58 and 60 may be positioned outboard of the heating elements 54, 56, and/or 62 and may also be fastened to the support structure 32. The transparent shield 46 may be arranged to slide into the support structure 32 and may be positioned so the air intake opening 52 is aligned with the circulating fan 42. Electrical wiring to the circulating fan 42 and to the heating elements 54, 56, and/or 62 may be accomplished by use of push-on "faston" terminals and mating connectors. Machine screw nuts can be used to secure the rear baffle 30 to the oven cell 12 of the oven 10. The transparent shield 46 may be slid into a center position and retained at that position using clips at the edges. The finger guard and splatter guard discussed above may be snapped into the air intake opening 52.

The rear baffle 30 according to one embodiment of the present invention provides radiative illumination of the heating cavity 14 for faster preheat and cooking, includes a catalyst for improved air cleaning, and is easier to service because all elements are mounted on a common structure. These improvements are not possible with a broiler element that is positioned to look downward and broil (brown) the upper surface of food. Nor are these improvements possible with a bake element that is positioned generally beneath the food in such manner to heat highly reflective food pans. The oven 10 is designed to operate effectively over a wide range of cooking temperatures (350° F. to 500° F.). The oven 10 furthermore provides high quality operation at typical "bread proofing, food warming" temperatures (80° F. to 350° F.). At self-clean temperatures (500° F. to 900° F.), the rear baffle 30 provides significant improvement in air cleaning and energy efficiency.

The rear baffle 30 can be used in closed door broil and/or bake cooking operations where the catalyst action handles smoke and odor created from high surface heat transfer.

The rear baffle 30 can be used in freestanding ranges and in single and double wall ovens. The rear baffle 30 can be used in residential and commercial cooking equipment and as the primary heating system for warming drawers and for low temperature applications, such as bread proofing, where the rear baffle 30 significant reduces byproducts of the fermentation process. Several of the rear baffles 30 can be used in larger and/or taller ovens as are encountered in the food service industry.

In one embodiment, an infrared transparent glass shield and infrared heaters are used to heat the oven cavity by direct radiation and, as well, to heat the catalyst positioned in proximity to the heaters so that re-circulated contaminated air can be oxidized at temperatures that are relatively high in connection with the catalyst but are relatively low oven temperatures. The catalyst is manufactured and supplied in a generally rectangular shape, and the heater used in this embodiment of the present invention is also generally rectangular in shape and is positioned to efficiently heat the catalyst to temperatures sufficient for satisfactory operation. The heater can be a circular heater around the fan impeller, or redundant heaters can be used for fault tolerant operation so that, in the event that one heater fails, one or more other heaters are available to heat the catalyst. Wings and other air directing elements may also be included on an integral metal structure to deflect heated air to food products placed in the oven cavity. This novel configuration is not suggested by either Durth or Ookubo.

Certain modifications of the present invention have been discussed above. Other modifications of the present invention will occur to those practicing in the art of the present invention. For example, as described above, the cell bottom 22 has an opening 24 to receive a heating element that is utilized to the heat the heating cavity 14, and the cell top may also have a similar opening to receive a further heating element that is utilized to the heat the heating cavity 14. Instead, only the cell top or the cell bottom need have an opening to receive a heating element that is utilized to the heat the heating cavity 14.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. An oven comprising:

a top;

a bottom;

first and second vertical sides, wherein the top, the bottom, and the first and second vertical sides define a heating cavity that receives food to be heated; and, a baffle positioned to circulate air in from the heating cavity, through the baffle, and back out to the heating cavity, wherein the baffle includes a fan, a catalyst, a heating element, and an IR transparent shield between the heating cavity on one side of the IR transparent shield and the fan, the catalyst, and the heating element on the other side of the IR transparent shield, wherein the fan circulates the air, wherein the heating element produces radiation, wherein the catalyst removes contaminants from the circulating air, and wherein the IR transparent shield permits the radiation to enter the heating cavity.

2. The oven of claim 1 wherein the heating element is located between the fan and the catalyst.

3. The oven of claim 1 wherein the heating element is positioned so as to heat the catalyst.

4. The oven of claim 1 wherein the baffle includes a support structure, wherein the fan comprises a fan impeller coupled to a fan motor by a shaft, wherein the heating element, the fan impeller, and the catalyst are positioned on one side of the support structure, wherein the fan motor is positioned on an opposite side of the support structure, and wherein the shaft extends through the support structure.

5. The oven of claim 1 wherein the baffle includes a support structure having a back wall and a wing, wherein the wing extends from the back wall at a non-right angle with respect to the back wall, and wherein the wing directs air circulated by the fan to the heating cavity.

6. The oven of claim 5 wherein the fan comprises a fan impeller coupled to a fan motor by a shaft, wherein the heating element, the fan impeller, and the catalyst are positioned on one side of the back wall, wherein the fan motor is positioned on an opposite side of the back wall, and wherein the shaft extends through the back wall.

7. The oven of claim 1 wherein the IR transparent shield includes an opening permitting air to enter the baffle from the heating cavity.

8. An oven comprising:

a top;

a bottom;

first and second vertical sides, wherein the top, the bottom, and the first and second vertical sides define a heating cavity that receives food to be heated; and, a baffle positioned to circulate air in from the heating cavity, through the baffle, and back out to the heating cavity, wherein the baffle includes a fan, a catalyst, and a support structure, wherein the fan circulates the air, wherein the catalyst comprises a honeycomb that removes contaminants from the circulating air, wherein the support structure has a wall and a wing, and wherein the wing extends at a non-right angle from the wall and directs air circulated by the fan back into the heating cavity.

9. The oven of claim 8 further comprising a heating element, wherein the heating element is located between the fan and the catalyst.

10. The oven of claim 8 further comprising a heating element, wherein the heating element is positioned so as to heat the catalyst.

11. The oven of claim 8 wherein the fan comprises a fan impeller coupled to a fan motor by a shaft, wherein the heater, the fan impeller, and the catalyst are positioned on one side of the support structure, wherein the fan motor is positioned on an opposite side of the support structure, and wherein the shaft extends through the support structure.

12. The oven of claim 8 wherein the baffle further comprises an IR transparent shield between the heating cavity on one side of the IR transparent shield and the fan and the catalyst on an opposite side of the IR transparent shield.

13. The oven of claim 12 wherein the IR transparent shield includes an opening permitting air to enter the baffle from the heating cavity.

14. An oven baffle comprising:

a fan;

first and second catalysts;

a heater located so as to heat the first and second catalysts; and, a support structure arranged to be removable from an oven interior surface, wherein the support structure supports the fan, the first and second catalysts, and the heater, wherein the fan is arranged to circulate air over the heater and the first and second catalysts, wherein the support structure includes first and second wings, wherein the first wing is arranged to deflect air circulated by the fan in one direction, and wherein the second wing is arranged to deflect air circulated by the fan in an opposite direction.

15. The oven baffle of claim 14 wherein the support structure has a wall, wherein the first wing extends at a non-right angle from the wall, and wherein the second wing extends at a non-right angle from the wall.

16. The oven baffle of claim 15 wherein the wall has opposing first and second ends, wherein the first wing extends at a non-right angle from the first end of the wall, and wherein the second wing extends at a non-right angle from the second end of the wall.

17. The oven baffle of claim 15 wherein the wall supports the fan, the heater and the first and second catalysts.

18. The oven baffle of claim 14 wherein the heater is located between the fan and the first ands second catalysts.

19. The oven baffle of claim 18 wherein the heater comprises an arcuate heater.

20. The oven baffle of claim 18 wherein the heater comprises a first heater between the fan and the first catalyst and a separate second heater between the fan and the second catalyst.

21. The oven baffle of claim 14 wherein the support structure has a wall, wherein the first wing extends at a non-right angle from the wall, wherein the second wing extends at a non-right angle from the wall, wherein the fan comprises a fan impeller coupled to a fan motor by a shaft, wherein the heater, the fan impeller, and the catalyst are positioned on one side of the support structure, wherein the fan motor is positioned on another side of the support structure, and wherein the shaft extends through the support structure.

22. The oven baffle of claim 21 wherein the wall supports the fan, the heater and the first and second catalysts.

23. The oven baffle of claim 14 wherein the support structure has a wall having first and second opposing ends, wherein the first wing extends at a non-right angle from the first end of the wall, wherein the second wing extends at a non-right angle from the second end of the wall, wherein the fan comprises a fan impeller coupled to a fan motor by a shaft, wherein the heater, the fan impeller, and the catalyst are positioned on one side of the support structure, wherein the fan motor is positioned on another side of the support structure, and wherein the shaft extends through the support structure.

24. The oven baffle of claim 23 wherein the wall supports the fan, the heater and the first and second catalysts.

25. The oven baffle of claim 14 further comprising an IR transparent shield supported by the support structure between the heating cavity on one side of the IR transparent shield and the fan, the first and second catalysts, and the heater on the other side of the IR transparent shield.

26. The oven baffle of claim 25 wherein the IR transparent shield includes an opening permitting air to enter the oven baffle from the heating cavity.

27. The oven of claim 8 wherein the honeycomb comprises stacked ripple strips.

28. The oven of claim 8 wherein the honeycomb comprises a honeycomb structure with platinum plating.

* * * * *